United States Patent [19]

Deutsch

[11] 4,257,304

[45] Mar. 24, 1981

[54] SIMULTANEOUS VOICE PITCHES IN A POLYPHONIC TONE SYNTHESIZER

[75] Inventor: Ralph Deutsch, Sherman Oaks, Calif.

[73] Assignee: Kawai Musical Instrument Mfg. Co., Ltd., Hamamatsu, Japan

[21] Appl. No.: 65,312

[22] Filed: Aug. 9, 1979

[51] Int. Cl.[3] ..... G10H 1/06

[52] U.S. Cl. ..... 84/1.23; 84/1.01

[58] Field of Search ..... 84/1.23, 1.19, 1.01, 84/1.22

[56] References Cited

U.S. PATENT DOCUMENTS

| | | | |
|---|---|---|---|
| 3,992,970 | 11/1976 | Chibana et al. | 84/1.19 |
| 4,089,644 | 4/1978 | Deutsch et al. | 84/1.01 |
| 4,122,742 | 10/1978 | Deutsch | 84/1.19 |

*Primary Examiner*—J. V. Truhe

*Assistant Examiner*—Forester W. Isen

*Attorney, Agent, or Firm*—Ralph Deutsch

[57] ABSTRACT

In a musical instrument having one or more tone generators in which a plurality of data words corresponding to the amplitudes of a corresponding number of evenly spaced reference points defining the waveform of an audio signal are transferred sequentially from a note register to a digital-to-analog converter in repetitive cycles at a rate proportional to the pitch of the tone being generated, apparatus is provided for simultaneously creating tones at two different pitches. The reference points are computed using specified wave shape symmetry characteristics such that a single variable frequency oscillator suffices to generate both tone pitches without requiring separate, or time shared, tone generation channels.

29 Claims, 7 Drawing Figures

SIMULTANEOUS VOICE PITCHES IN A POLYPHONIC TONE SYNTHESIZER

BACKGROUND OF THE INVENTION

1. Field of the Invention

This invention relates broadly in the field of electronic generators and in particular is concerned with an improvement for simultaneously producing voices at different pitches in musical tone generators.

2. Description of Prior Art

One of the tonal requirements for an electronic musical instrument is the capability of generating voices, or tones, at a variety of pitches. The pitch of a voice is fundamental frequency. In electronic musical instruments of the organ type, pitches are usually expressed in feet in accordance with pipe organ terminology. Thus an 8-foot pitch is the "normal" pitch because the note $A_4$ will have at a fundamental frequency of 440 hz. When an 8-foot stop, or tone switch, is actuated tones are produced at the same pitch as the selected key. Thus if the keyboard switch is actuated, a note will be sounded at the pitch having a fundamental frequency of 440 hz. If a 16-foot stop is selected, the instrument will produce tones at a pitch one octave lower than the actuated keyboard switch. That is if the keyboard switch corresponding to $A_4$ is actuated, the output tone will have a pitch corresponding to $A_3$. Higher voice pitches are also implemented. For example, a 4-foot stop and a 2-foot stop respectively result in producing notes one and two octaves higher than the actuated keyboard switch.

Frequently the musician will combine different voice pitches to obtain a new composite tone color. If a 16-foot and 8-foot step are used simultaneously, the instrument will produce a composite sound of the unison, or 8-foot pitch, and one an octave lower. Higher pitches can also be added by using stops of shorter than 8-foot pitch. Thus a 1 3/5 foot voice may be used to enhance, or add to, the fifth and tenth harmonics of a simultaneously selected 8-foot stop.

In electronic musical tone generators such as the Polyphonic Tone Synthesizer described in U.S. Pat. No. 4,085,644 and the Computor Organ described in U.S. Pat. No. 3,809,786 musical waveshapes are generated by a computational algorithm. These computational algorithms are of the Fourier type in which the waveshape, or tonal structure, is determined by selected sets of harmonic coefficients. The stop switches are used to select these harmonic coefficients which reside in addressable memories. For such tone generators, all standard organ footages shorter than 8-foot can be generated by supressing selected harmonics as described in detail in U.S. Pat. No. 3,809,786. For example, a 4-foot pitch tone is created by using the basic 8-foot generator and selecting a set of harmonic coefficients having a zero value for all the odd-numbered harmonics. The tonal result is a voice created at an octave above the normal 8-foot generator.

The use of harmonic suppression to generate lower footage voices will restrict the number of harmonics available as a function of the pitch. A 4-foot voice will be limited to one-half of the number of harmonics available for the normal 8-foot tones. A 2-foot voice will have only one-quarter of the number of harmonics available for the normal 8-foot tone.

The simultaneous generation of 16-foot and 8-foot voices in musical systems of the Fourier synthesis type can be accomplished by having the 16-foot pitch as the normal pitch. The 8-foot and shorter footages could be obtained by the method of harmonic suppression. Such systems are impractical in many cases because of the reduction in harmonics for the higher pitches. If the normal or 16-foot pitch is limited to 16 harmonics, then an 8-foot voice having only 8 harmonics is not adequate for the majority of electronic musical instruments.

Prior art systems have resorted to independent tone generators for the 16-foot pitch voices and the 8-foot pitch voices to overcome the problem of reduced harmonics caused by using harmonic suppression to generate the higher voice pitches. A method for simultaneously implementing 16-foot and higher pitched voices for the Computor Organ of U.S. Pat. No. 3,809,786 is described in U.S. Pat. No. 3,809,790 entitled Implementation of Combined Footage In A Computer Organ. The system described in U.S. Pat. No. 3,809,790 contains both an 8-foot tone generator and an independent 16-foot tone generator. In a preferred embodiment 16 time slots are alloted for the generation in real time of a single point on the desired waveshape amplitude. A selected subset of these time slots are allocated to the 8-foot generator and the remaining time slots are allocated to the 16-foot generator. As the preferred embodiment, the 8-foot time spectra is generated with the harmonic sequence 1,2,3,4,5,6, 7,8,10,12,14,16. The sequence of 9,11,13,15 harmonics are not produced by the 8-foot generator. The four missing harmonic time slots for the 8-foot generator are allocated to the 16-foot generator which uses these time slots to generate harmonics 1,3,5,7 of the 16-foot pitch fundamental frequency. The output from the 8-foot and 16-foot tone channels are added together and the sum is then converted to an analog signal to provide the current point on a real-time musical waveform.

Since the 8-foot harmonic components correspond to the even harmonic components of a 16-foot series, the net result is that an effective 16-foot spectrum is generated having the first eight harmonics, every other harmonic up to the 16th, and then every fourth harmonic from the 20th through the 32nd.

The system described in U.S. Pat. No. 3,809,709 for obtaining simultaneous 8-foot and 16-foot tones suffers several disadvantages. First, the system still requires two independent 8-foot and 16-foot tone computation channels. The only saving is in the computation time obtained by time sharing a common set of time slots used for calculation. Second, the output tones having missing harmonics which places a limitation on the possible tone colors that can be created.

The present invention provides a novel implementation for simultaneously generating both 16-foot and 8-foot voices in the basic Polyphonic Tone Synthesizer described in U.S. Pat. No. 4,085,644. Two significant advantages of the instant invention is that the tone creation system does not require separate and independent 8-foot and 16-foot tone generators and the 8-foot tones are created with no loss in the number of harmonics.

SUMMARY OF THE INVENTION

The present invention is directed to a novel and improved arrangement for simultaneously generating musical tones at 8-foot and 16-foot pitches in a polyphonic tone synthesizer of the type described in the previously referenced U.S. Pat. No. 4,085,644. This simultaneous tone pitch generation is accomplished in a single basic 8-foot tone generation channel with no loss in the number of harmonics used to generate an 8-foot tone.

In brief, this is accomplished by creating waveshapes data in master data sets having a particular waveshape symmetry. Two master data sets are computed during a computation cycle each such data set corresponding to the 8-foot and 16-foot tones. After the two master data sets have been generated they are combined and transferred to a plurality of tone generators and stored in note registers. The stored data is read out of these note registers by variable frequency clocks whose frequencies correspond to actuated keyboard switches. By addressing the data from the note registers in a forward and reverse order sequentially and cyclically the result is the creation of the desired multi-pitched musical waveforms. The output digital data are converted to analog signals which are provided to a conventional sound production system.

BRIEF DESCRIPTION OF THE DRAWINGS

For a better understanding of the invention reference should be made to the accompanying drawings.

DETAILED DESCRIPTION OF THE INVENTION

The present invention is directed to an improvement in the tone generation system for a polyphonic tone synthesizer of type described in detail in U.S. Pat. No. 4,085,644 entitled Polyphonic Tone Synthesizer and which is hereby incorporated by reference. In the following description, all portions of the system which have been described in the referenced patent are identified by two digit numbers which correspond to the same numbered elements used in the patent. All blocks which are identified by three digit numbers correspond to elements added to the polyphonic tone synthesizer to implement the improvements of the present invention.

Figure 1:
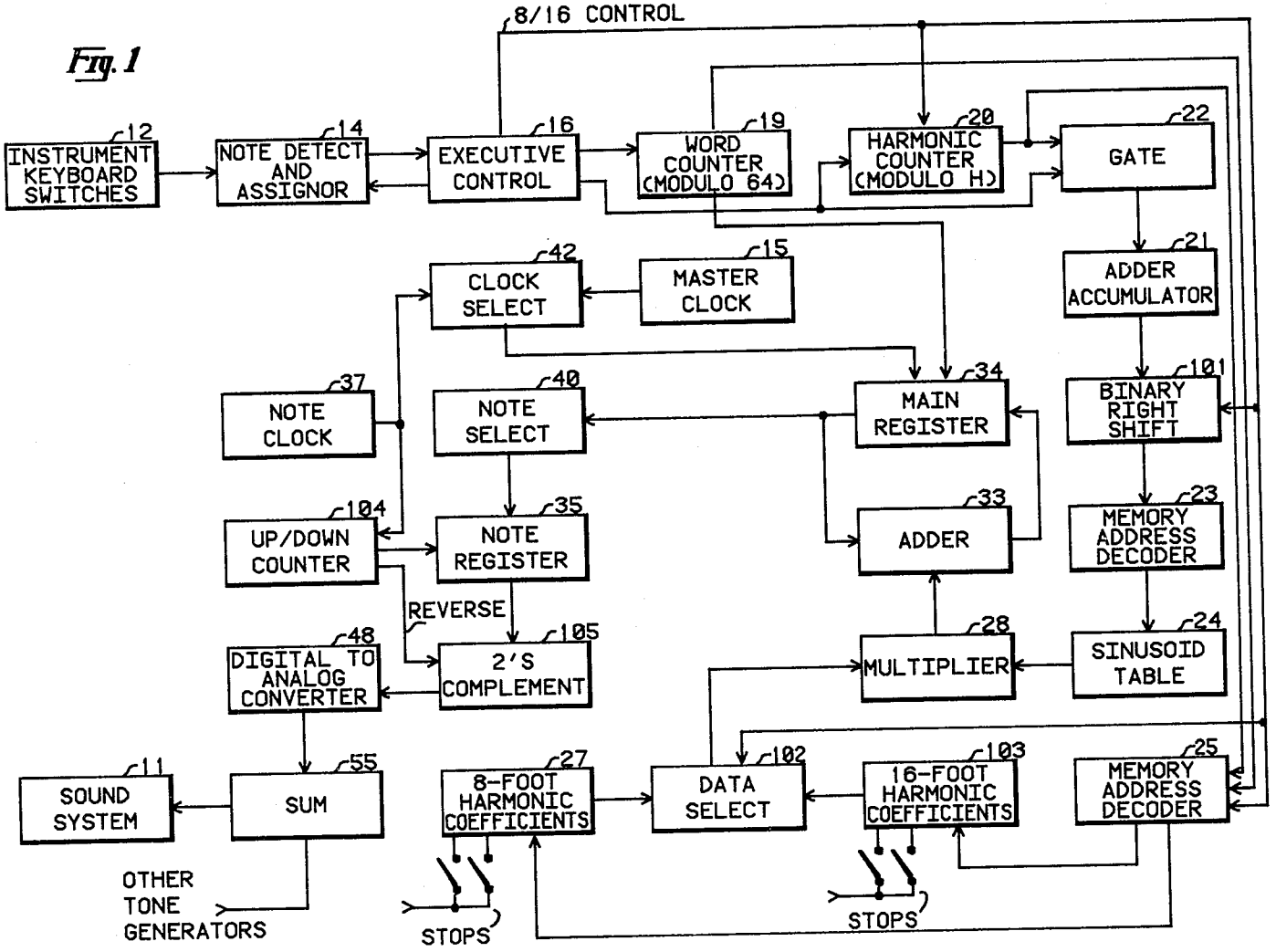
FIG. 1 is a schematic block diagram of an embodiment of the present invention.

FIG. 1 shows an embodiment of the present invention for simultaneously creating musical tones at 8-foot and 16-foot frequencies. The terms 8-foot and 16-foot frequencies are used in a generic sense to denote the fundamental frequencies. In either case, higher pitches (shorter footages) can readily be implemented using a harmonic suppression scheme such as that described in detail in U.S. Pat. No. 3,809,786.

Sound system 11 indicates generally an audio sound system capable of receiving and mixing up to twelve separate audio signals. Each input signal to the sound system is generated by its own tone generator in response to the actuation of a key on a conventional musical keyboard. The keys operate a corresponding keyswitch on the keyboard switches 12. Up to twelve keys may be operated simultaneously to generate as many as twelve simultaneous tones. It will be understood that a polyphonal system having twelve tones is only given by way of example and does not represent a system limitation. A tone generator consists of the system logic blocks: Note clock 37, up/down counter 104, note register 35, 2's complement 105 and digital-to-analog convertor 48. Only one of the set of twelve tone generators is showed explicitly in FIG. 1 it being understood that the remainder consist of groups of identical elements.

The set of tone generators all receive common data generated by the computation and control logic.

Whenever a key on the instrument keyboard is depressed and actuates a keyboard switch, note detect and assignor 14 stores information corresponding to the particular actuated keyboard switches and assigns that key to one of the twelve tone generators in the system which is not currently assigned. The note, or keyswitch, information and that the fact that it has been assigned to a particular tone generator is stored in a memory (not shown) in the note detect and assignor circuit 14. The operation of a suitable note and detect and assignor subsystem is described in U.S. Pat. No. 4,022,098 entitled Keyboard Switch Detect And Assignor which is hereby incorporated by reference.

A computation cycle is initiated by the executive control 16. The computation cycle is divided into an 8-foot computation cycle and a 16-foot computation cycle. During the 8-foot computation cycle a master set is calculated as described in U.S. Pat. No. 4,085,644 for 8-foot tones. The 8-foot computation cycle may be further subdivided into subcomputation cycles as described in the referenced patent. During these subcomputation cycles the harmonic coefficients selected by tone switches, or stops, are used as described to add to the resultant master data set. During the 16-foot computation cycle, the 16-foot tone data is generated in a particular manner, as described below, and point-wise added to the 8-foot computation cycle. In exact analogy with the method described for 8-foot tones, the 16-foot computation cycle can also be composed of a number of subcomputation cycles whenever a different 16-foot set of harmonics are selected by tone switches to add to the resultant master data set.

At the start of the 8-foot computation cycle, the executive control 16 sets the 8/16 control signal to the 8-foot state. This can be designated as the 8/16 signal being in the "0" logic state. The incrementing of the word counter 19 and harmonic 20 counter is described in the referenced patent. The word counter is implemented to count modulo 64. The content of this counter is used to address data into and out of the main register 34. The harmonic counter 20 is incremented each time the word counter 19 returns to its initial state. The contents of adder accumulator 21 are used to address sinusoid table 24 after being converted to the addressing data format by the memory address decoder 23. During the 8-foot computation cycle, in response to the "0" state of the 8/16 control signal, binary right shift 101 transfers data unaltered from the adder accumulator 21 to the memory address decoder 23. In response to the "0" state of the 8/16 control signal the memory address decoder selects the 8-foot harmonic coefficients which are shown to reside in the 8-foot harmonic coefficient 27, this being an addressable memory for storing a plurality of harmonic coefficients as described in the referenced patent. The particular harmonic coefficients addressed out from the 8-foot harmonic coefficient 27 are selected as a set by the state of the tone switches. The element in each such selected set of harmonic coefficients is selected in response to the current state of the harmonic counter 20.

The selected harmonic coefficient is multiplied in multiplier 28 by a sinusoid value addressed out from the sinusoid table 24. The resultant product is added to the current value in the main register 34 for the current address represented by the state of the word counter 19. The new value is placed in the main register to replace the previous value.

Following the 8-foot computation cycle, the 16-foot computation cycle is initiated. At the initiation of the 16-foot computation cycle, executive control 16 places the 8/16 control signal in the "1" state.

In response to the "1" state, memory address decoder selects the 16-foot harmonic coefficients 103. This is an addressable memory storing sets of harmonic coefficient corresponding to the desired 16-foot tones.

The 8/16 control signal is used by the data select 102 to determine which selected harmonic coefficients are to be transferred to the multiplier 28. In response to a "0" state, the addressed output harmonic coefficients from the 8-foot harmonic coefficient 27 are transferred by data select 102 to the multiplier 28. In response to a "1" state, the addressed output harmonics from the 16-foot harmonic coefficients 103 are transferred by data select 102 to the multiplier 28.

In response to a "1" state for the 8/16 control signal, binary right shift 101 will effect a shift to the right for data it receives before transferring such data to the memory address decoder. A right shift of one bit position, divides the magnitude of a binary number by 2. This right shift of one bit position is "essentially" equivalent to an division by two in the final generated musical frequency. It should be remarked that no actual frequency division has taken place as the right shift is not a frequency divider of any of the logic timing used during either the 8-foot or 16-foot computation cycles. The manner in which such a binary right shift produces an output frequency division is one of the novel features of the present invention. The remainder of the computational logic to generate the 16-foot contribution to the master data is essentially the same as for the 8-foot computation cycle. The difference being that of the action of the binary right shift 101 and the selection of the 16-foot harmonic coefficients. The 16-foot contributions to the master data set are added point-wise to the prior computed submaster data set obtained during the 8-foot computation cycle. The point-wise addition is controlled by the addresses furnished to the main register 34 by the word counter 19.

As described in the referenced patent, the master data values corresponding to the 8-foot selected tones are computed by using the discrete Fourier series of the form $$Z_N = \sum_{q=1}^{M} c_{q1}\sin(\pi Nq/2M) + \ldots + \sum_{q=1}^{M} c_{qj}\sin(\pi Nq/2M) \quad \text{(Eq.1)}$$

where $N=1,2,\ldots,2M$ is the number, or address of a master data set word, $q=1,2,\ldots,M$ is the harmonic number index, $c_{q1}$ to $c_{qj}$ are sets of harmonic coefficients corresponding each to a particular tone switch. M has the value of 32 which corresponds to a master data set having 64 data words. The individual terms in the summations in Eq. 1 are commonly called the harmonic components and in particular, for this case, they can be called the sinusoidal harmonic coefficients. The harmonic number index q is also sometimes called the order number or the order number of the harmonic component. It is known that a master data set computed using Eq. 1 will have an odd symmetry about the midpoint. That is $$Z_N = -Z_{65-N} \quad \text{(Eq. 2)}$$

Because of the previously described action of the binary right shift 101, the master data set computed during the 16-foot computation cycle will be computed according to the relation $$X_N = \sum_{q=1}^{M} d_{q1}\sin(\pi Nq/2M) + \ldots + \sum_{q=1}^{M} d_{qj}\sin(\pi Nq/2M) \quad \text{(Eq.3)}$$

The factor 2 appears in the denominator of the argument of the sinusoid functions because of the division by two action of the binary right shift 101 during the 16-foot computation cycle. It is remarked that the values of $X_N$ for $N=1,2,\ldots,64$ do not constitute a full cycle of the 16-foot waveshape data. A full cycle, because of the factor 2 in the sinusoid argument, would require $2\times 64=128$ data points. Thus the values of $X_N$ are odd symmetric about the end point, or $$X_N = -X_{129-N} \quad \text{(Eq. 4)}$$

The values of $X_N$ are added point-wise to the values of $Z_N$ to produce the resultant master data set values $$Y_N = Z_N + X_N;\ N=1,2,\ldots,64 \quad \text{(Eq. 5)}$$

It is also remarked that the values of $Z_N$ are also odd symmetric about the endpoint, or $$Z_N = -Z_{129-N} \quad \text{(Eq. 6)}$$

The values for N greater than 64 are not contained in the master data set of 64 data words so that Eq. 4 and Eq. 6 illustrate a property that would result if two master data sets were combined in a contiguous fashion to form a new set of data values having 128 data elements.

Following the completion of both segments of the computation cycle, the master data set residing in the main register 34 is transferred to a plurality of note registers, such as note register 35. The manner in which this data transfer is accomplished without interfering with the generation of the musical tones is described in the referenced U.S. Pat. No. 4,085,644.

The note register 35 is an addressable read/write memory (RAM). Data is addressed out from the note register 35 at a rate determined by the corresponding note clock 37. There are a variety of methods for implementing the note clock 37 which may be a voltage controlled oscillator. One such implementation is described in detail in U.S. Pat. No. 4,067,254 entitled Frequency Number Controlled Clocks which is hereby incorporated by reference.

Note Clock 37 provides a train of clock pulses which is used to increment the up/down counter 104. This up/down counter counts modulo 64 which is the number of data words stored in the note register 35. The state of the up/down counter is used to address data into or out of the note register 35. When the up/down counter 104 is in the increasing count state, a "0" reverse signal state is transmitted to the 2's complement 105. In response to this "0" state, the 2's complement will transfer data addressed out from the note register unaltered to the digital-to-analog converter 48. When the up/down counter 104 is in the decreasing count state, the reverse signal is placed in the "1" logical state. In response to the "1" logical state, the 2's complement 105 will perform a 2's complement on the binary number data addressed out from the note register 35 and then transmit the result to the digital-to-analog converter. The counting mode of the up/down counter can be made responsive to a control signal which establishes the count direction.

The digital-to-analog converter 48 operates to convert its input digital data to an output analog signal. The analog signals from the remainder of the plurality of tone generators are combined in sum 55 and provided as a single composite signal to the sound system 11.

It is noted that note clock 37 operates at the same frequency as that described in U.S. Pat. No. 4,085,644 for 8-foot tones. Thus the present invention provides for simultaneous 16-foot and 8-foot tones with all the system logic and note clocks operating at the same frequencies that are required for only 8-foot tone generation. The extra 16-foot tone capability is obtained by using circuitry which implements the previously described master data set symmetries.

It is an obvious modification to use bi-directional shift registers operated in an end-around mode to replace the addressable memories used for the note registers.

Instead of computing a master data set having odd symmetric properties, a master set can be computed which has even symmetric properties. The use of even symmetry is described in the referenced U.S. Pat. No. 4,085,644. To generate a composite master data set with even symmetry the sin terms in Eq. 1 and Eq. 3 are replaced by cos terms. The sinusoid table 24 will store cosine values of the arguments instead of the sine values. For even symmetry, in place of Eq. 4 and Eq. 6, the even property is $$X_N = X_{129-N} \quad \text{(Eq. 7)}$$

$$Z = Z_{129-N} \quad \text{(Eq. 8)}$$

The system shown in FIG. 1 can also be used for the case of an even symmetric master data by eliminating the 2's complement 105. With an even symmetric master data the data read out of the note register 35 is always transferred unaltered to the note register 35.

The referenced U.S. Pat. No. 4,085,644 describes the use of a generalized discrete Fourier series to compute the elements of the master data set. These generalized discrete Fourier series algorithms can also be employed in the present invention provided that the family of orthogonal functions used have either an even or odd symmetric characteristic. Such symmetry does exist for the Walsh functions so that the present invention can be implemented as described in U.S. Pat. No. 4,085,644 using Walsh functions instead of the simple trigonometric sine or cosine functions. Tables of the selected orthogonal functions are used to replace the sinusoid table 24.

While the operation of FIG. 1 was described using the terminology of 8-foot and 16-foot pitches this is not a limitation of the invention. The term 8-foot pitch as used implies 8-foot pitch and any higher pitch that can be obtained by the previously described method of harmonic suppression. Similarly the term 16-foot pitch implies 16-foot pitch and higher pitches based on a 16-foot fundamental obtained by the method of harmonic suppression. It is also evident that the use of the terms 8-foot and 16-foot for the two segments of the computation cycle represent a first segment for computing one pitch and a second segment for computing tones which will sound at an octave lower in pitch. In the following the generic terms of first and second segments of the computation cycle will be used. It is understood that both the first and second segments of the computation may be further divided into computation subsegments corresponding to the actuated tone switches, or stops, for each of the family of tones for the first and second computation cycle.

As described above, both the 8-foot tone and 16-foot tones are computed with the full normal 32 harmonic waveshape capability of the polyphonic tone synthesizer. It is noted that the 16-foot tones are computed with 64 points for a half cycle of their waveshape. Therefore, the 16-foot can be synthesized from an enlarged set of 64 harmonic coefficients. The simple rule for such periodic waveshapes is that for equally spaced amplitude points the maximum number of harmonics is equal to one-half of the number of such amplitude points for a full period of the waveshape.

Figure 2:
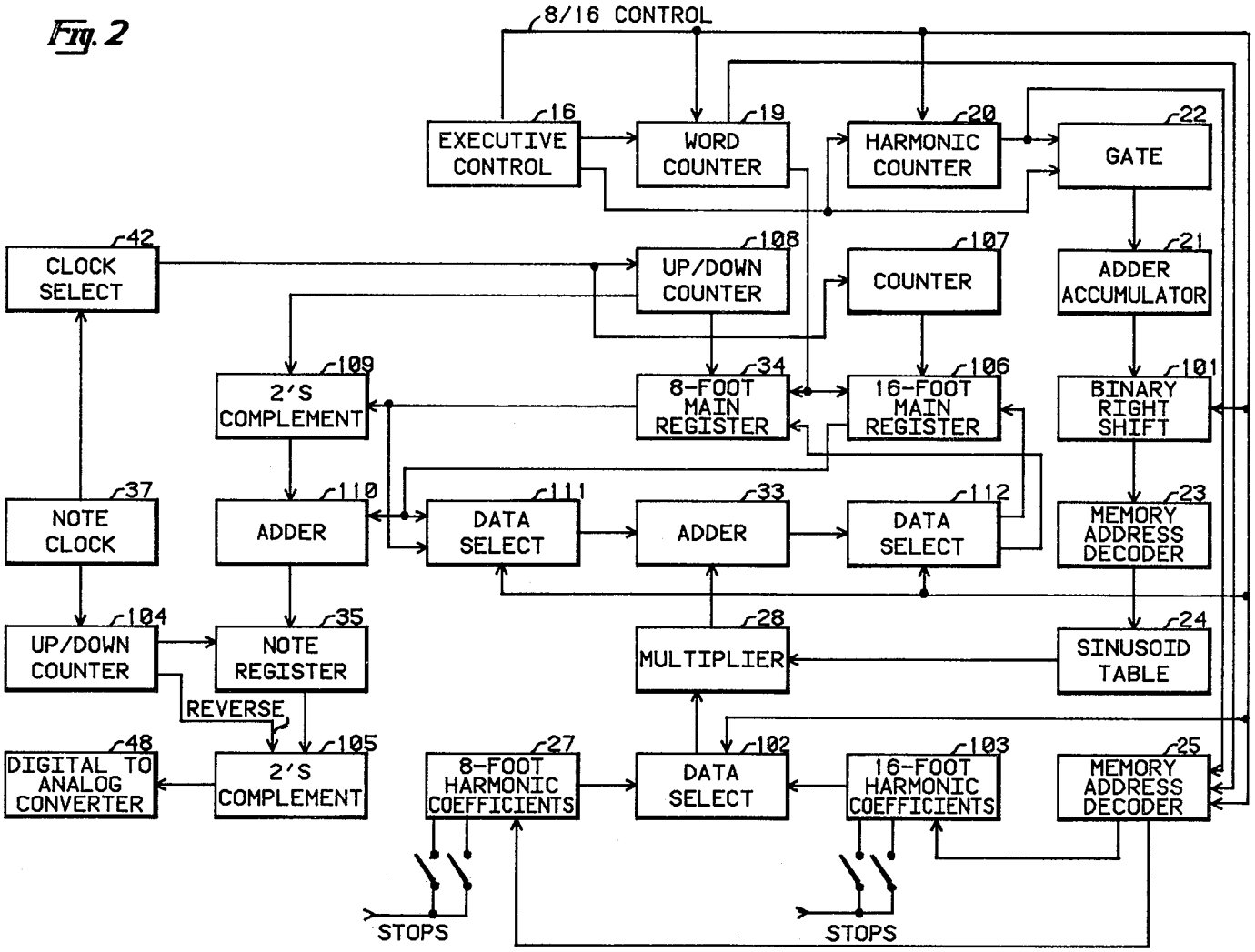
FIG. 2 is a schematic block diagram of another embodiment of the present invention.

The number of harmonics computed during the first and second segments of the computation cycle can be controlled by means of the 8/16 control signal created by the executive control 16. In response to a "0" state of the 8/16 control signal, harmonic counter 20 is caused to count modulo H=32 and in response to a "1" state the harmonic counter is caused to count modulo H=64. FIG. 2 shows an alternative system configuration to the system shown in FIG. 1 and previously described. A feature of the alternative system shown in FIG. 2 is that the length of time required for the first segment of the calculation cycle is shortened. The shortened time is obtained by using the half-period symmetry of the 8-foot waveshapes described previously and defined in Eq. 2 for odd symmetry.

In FIG. 2, the 8-foot main register contains 32 data words while the 16-foot main register contains 64 data words.

In response to the "0" state of the 8/16 control signal during the first segment of the computation cycle word counter 19 is caused to count modulo 32 and the harmonic counter 20 is caused to count modulo 32.

During the first segment of the computation cycle, data select 111 and data select 112 respond to the "0" state of 8/16 control signal to the end that the current value in adder 33 is added to data read out of the 8-foot main register 34 at the address determined by the state of the word counter 19. The new sum is then replaced in the same memory address position.

During the second segment of the computation cycle, in response to the "1" state of the 8/16 control signal both the word counter 19 and the harmonic counter 20 are caused to count modulo 64.

The harmonic coefficients for the 8-foot pitch voices consist of sets of 32 harmonics which are selected by means of the stop switches. The 16-foot harmonic coefficients, for the system shown in FIG. 2, consist of sets of 64 harmonics which are selected by means of the stop switches.

If only 32 harmonics are desired for the 16-foot pitch voices then the harmonic sets would consist of 32 harmonics, and the harmonic counter 20 would count modulo 32 during the second segment of the computation cycle.

During a transfer cycle of the data from the two main registers to the selected note registers, the data read out from the 8-foot main register 34 is addressed by the up/down counter 108 which counts to 32 and then reverses its count direction. While the up/down counter 108 is in the increasing count state, the data read out from the 8-foot main register 34 is transferred unaltered to the adder 110. While the up/down counter 108 is in the decreasing count state, a REVERSE signal is placed in state "1". In response to a state "1" for the REVERSE signal, the 2's complement 109 will perform a 2's complement on the binary data words read out from the 8-foot main register 34 before this data is transferred to the adder 110.

During the same transfer cycle described above, counter 107 counts modulo 64 and its contents are used to address data out from the 16-foot main register 106. The 8-foot master data set is combined with the 16-foot master data set in the adder 110 to form a combination master data set and the sum is written into one of the note registers in the plurality of tone generators such as note register 35 which is shown explicitly in FIG. 2.

In analog with FIG. 1, only one of the plurality of tone generators is shown explicitly in FIG. 2 as consisting of the system logic blocks: note register 35, 2's complement 105, note clock 37. up/down counter 104 and digital-to-analog converter 48. It is understood that the remainder of the plurality of tone generators contain additional sets of the same system elements.

The method of reading data out of note register 35 is the same as that previously described for the system shown in FIG. 1.

If the two master data sets are computed using a discrete generalized Fourier transform to obtain data with even symmetry then the 2's complement 109 shown in FIG. 2 is eliminated so that the data addressed out from the 8-foot main register 34 is transferred unaltered to the adder 110. Moreover, as previously described in connection with FIG. 1, the 2's complement 105 is not used if the master data sets are computed to have even symmetry.

In the copending patent application Ser. No. 028,038 entitled Even-Odd Symmetric Computation In A Polyphonic Tone Synthesizer, filed Apr. 4, 1979, there is described an invention for reducing the length of a computation cycle in a tone generator of the type described in the referenced U.S. Pat. No. 4,085,644. The referenced application has a common assignee with the present invention. Features of the invention described in Application Ser. No. 028,038 can be combined with the present invention to provide a significant reduction in the length of the computation cycle while retaining the objectives of producing simultaneous tones at the 8-foot and 16-foot pitches.

The reduction in the length of time required for a segment of the computation cycle is accomplished by decomposing each master data set into two component submaster data sets. The first component submaster data set is computed by using only the odd harmonic coefficients for a selected tone while the second component submaster data is computed by using only the even harmonic coefficients for the same selected tone. The component master data sets are stored in two addressable memories. These data sets are computed only for a number of data points equal to $\frac{1}{4}$ of a full waveshape cycle. During a data transfer cycle, the desired full cycle waveshape data is created by forward and reverse addressing of the data stored in the two memories. The addressed data is complemented and combined in a specified manner so that the full cycle waveshape is created from 16 master data set points instead of from a set of 64 data set points as required for the note registers in the set of tone generators.

In general all master data sets computed according to Eq. 1 will not have any predetermined symmetry about the one-quarter cycle point of 16. However, in a manner to be described below, it is possible to force a one-quarter cycle symmetry without any restrictions on the set of harmonic coefficients used in the algorithm to compute the values of the master data set.

Figure 3:
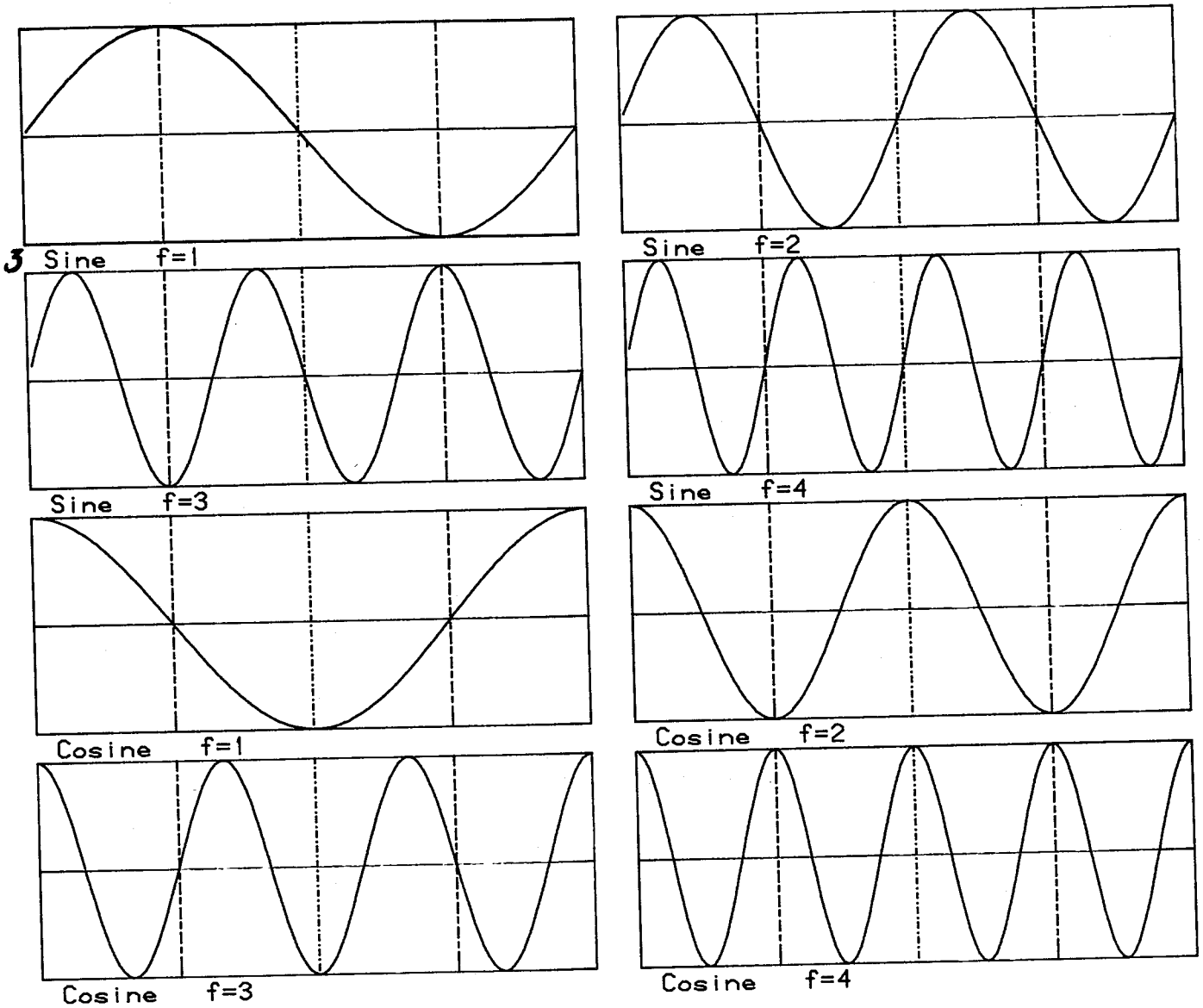
FIG. 3 is a graphic illustration of the waveshape symmetries of even and odd harmonics.
Figure 4:
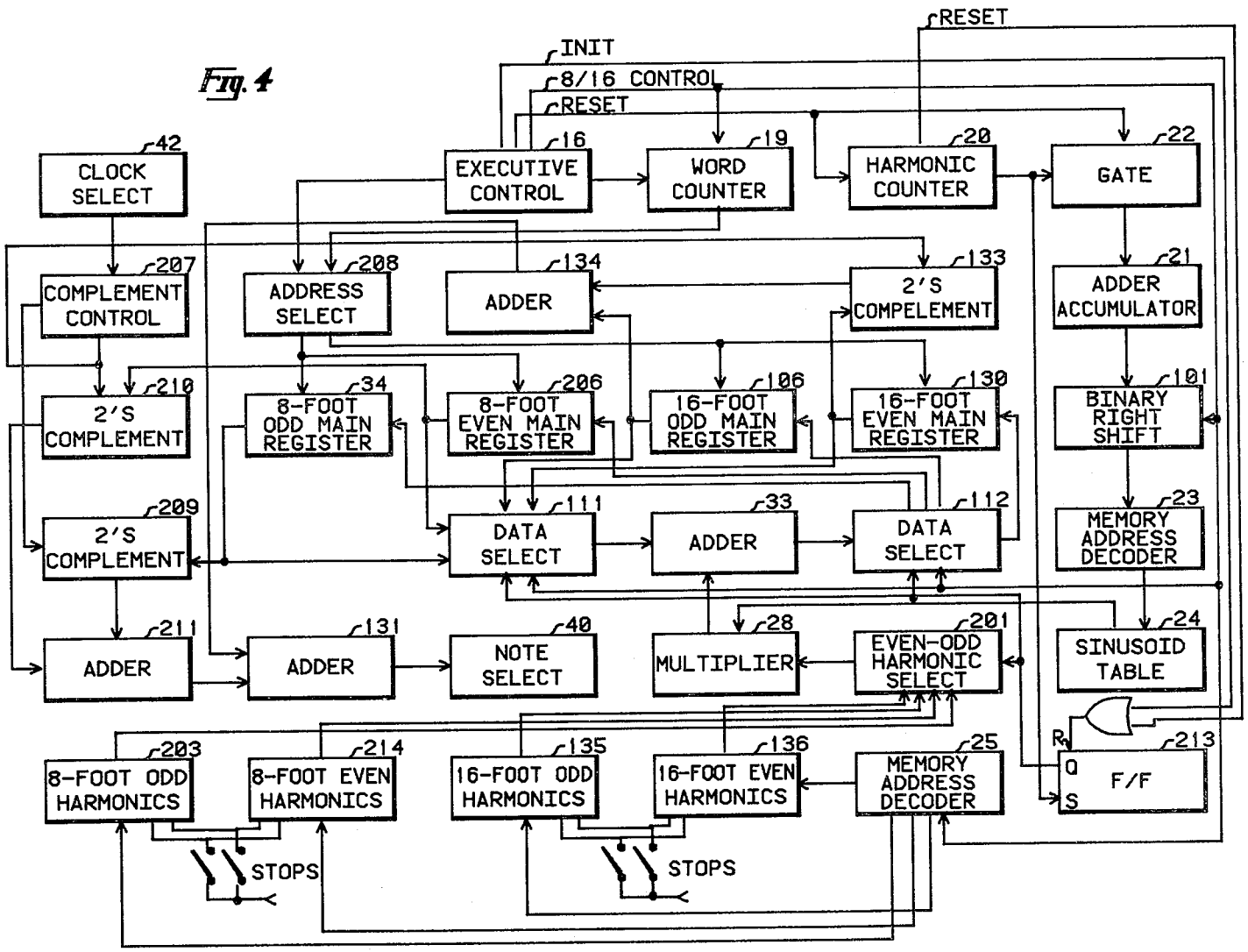
FIG. 4 is a schematic block diagram of yet another embodiment of the present invention.

FIG. 3 shows the graphs for the first four harmonics for a full cycle of a waveshape comprising 64 points. The top four graphs illustrate the sine function. The dot-dashed lines are drawn at the one-half cycle point for the fundamental. The sine harmonics all exhibit odd-symmetry about the one-half cycle point. The dashed lines are drawn at the one-quarter cycle points. The odd sine harmonics have an even symmetry about the one-quarter cycle points. Thus if a component master data set is computed using only the odd harmonics, the result will be a set of data points which will be even symmetric about the one-quarter point, point 16, and which will retain the odd-symmetric property about the one-half cycle point, or point 32. Analogously, if a component master data set is computed using only the even harmonics, the result will be odd-symmetric about the one-quarter point and will also retain the odd-symmetric property about the one-half cycle point. The component master data sets can be summed to obtain the required data sets of 64 which is transferred during the transfer cycle to the note registers. The remainder of the 64 points are constructed by appropriate circuit logic which implements the above symmetry properties as the master data set points are transferred to the note registers. FIG. 4 illustrates a system for simultaneously generating 8-foot and 16-foot voice pitches and which includes further waveshape symmetry properties to reduce the length of time required for a computation cycle. For the system shown in FIG. 4, the computation cycle is again partitioned into a first and second segment. The 8-foot master data set components are computed during the first segment and the 16-foot master data set components are computed during the second segment.

At the start of a computation cycle, the executive control 16 creates an INIT signal. The INIT signal is used to reset the flip-flop 213 through a logic OR gate. Each time word counter 19 is reset to its initial stage because of its modulo counting, a RESET signal is generated and sent to the memory address decoder 25.

When flip-flop 213 is reset at the start of a computation cycle, the output Q is a state "0". If Q is a "0", the even-odd harmonic select 201 will transfer the odd harmonic coefficients addressed out from the 8-foot odd harmonics 203 to the multiplier 28. The particular addressed sets of harmonic coefficients are selected by the actuation of the stop switches. The Q="0" of the state "0" of the 8/16 control signal causes data read out of the 8-foot odd main register 34 to be transferred to the adder 33 via data select 11. These same two "0" states cause the summed data from adder 33 to be transferred via data select 112 to be written into the 8-foot odd main register 34.

The above operation continues during the first portion of the first segment of the computation cycle during which the word counter 16 is cycled for 16 complete cycles and the harmonic counter 20 is incremented by 15 counts from its initial state. At the next logic master clock timing pulse, the harmonic counter is reset to its initial state because of its modulo count implementation and the harmonic counter generates a RESET signal.

The RESET signal from the harmonic counter is used to set the flip-flop 213 and thereby causes the signal Q to be in the "1" state. When Q is "1" and the 8/16 control signal is "0", the even-odd harmonic select 201 will transfer the even harmonics addressed out from the 8-foot even harmonics 214 by the memory address decoder to the multiplier 28.

For the state Q="1" and a "0" state for the 8/16 control signal, data select 111 will transfer data read out of the 8-foot even main register 206 to the adder 33 and data select 112 will transfer the summed data from adder 33 to be written into the 8-foot even main register 206.

At the end of the second 16 counts of the harmonic counter 20, the second, or even, part of the first segment of the computation cycle is completed.

During the second segment of the computation cycle the 16-foot master data set is computed in two components in the same fashion as described above for the 8-foot master data set. The difference in operation being that now harmonic coefficients are selected from the 16-foot odd harmonics 135 and the 16-foot even harmonics 136 and the resultant master data set component values are stored in the 16-foot odd main register 106 and the 16-foot even main register 130. The selection of even and odd 16-foot harmonic data is made by even-odd harmonic select 201 in response to the state of the flip-flop 213 and a "1" state for the 8/16 control signal. A similar selection of data is made by data select 111 and data select 112. Also during the second segment of the computation cycle, the 8/16 control signal causes the binary right shift 101 to shift its input data in the manner previously described in reference to FIG. 1.

For the preferred embodiment, both 8-foot and 16-foot tones are each generated having a maximum number of 32 harmonics. The 8-foot main registers 34 and 206 will contain 16 data words while the 16-foot main registers will contain 32 data words.

Following the completion of the first and second segments of the computation cycle a transfer cycle is initiated.

Figure 5:
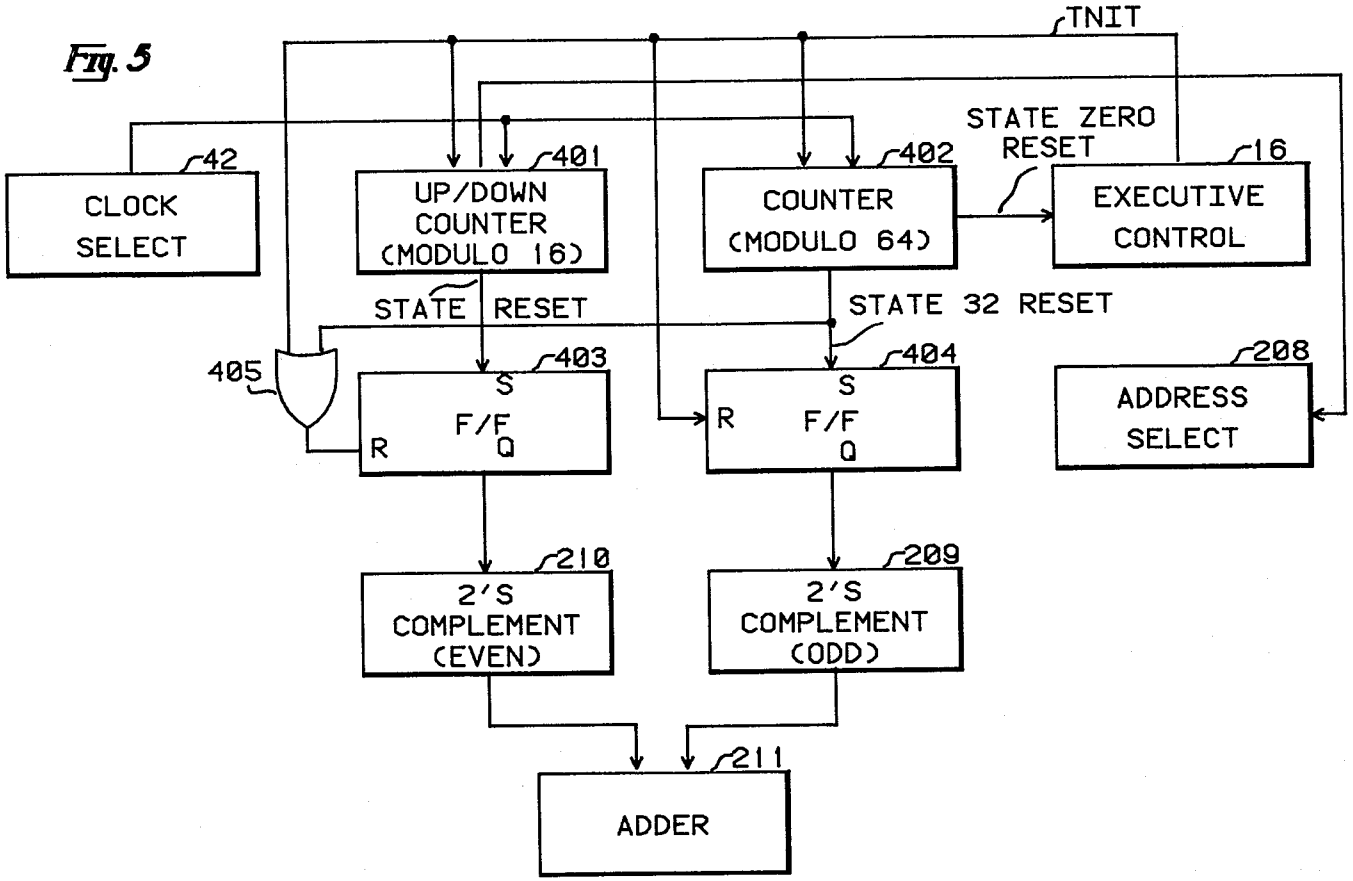
FIG. 5 is a schematic block diagram of the complement control logic.

During a transfer cycle, the stored data residing in the 8-foot odd main register 34 and the 8-foot even main register are read out and combined under the direction of the complement control 107. The details of the complement control are shown in FIG. 5 and described below. The purpose of the complement control 207, shown in FIG. 5, is to combine during a transfer cycle the component master data sets of 16 points into a single combination master data consisting of 64 points. At the start of a transfer cycle, a TINIT signal is generated by the executive control 16. The presence of a "1" state of the TINIT signal is used to reset the up/down counter 401, the counter 402, flip-flop 403, and flip-flop 404.

Counters 401 and 402 are incremented by timing clock signals transferred by clock select 42. The manner in which these clock signals are selected is described in the previously referenced U.S. Pat. No. 4,085,644.

The up/down counter 401 counts from 1 to 16 and then from 16 to 1 in a repetitive fashion as it is incremented by the timing signals selected by clock select 42.

For the first 16 counts of the up/down counter 401, the output state of the flip-flop 403 is Q="0". In response to the state Q="0", the 2's complement 210 does not perform any alteration on the data it receives from the 8-foot even main register 206 before it is transferred to the adder 211. Thus the first 16 words addressed out from the 8-foot even main register 206 during the transfer cycle are transferred unaltered to the adder 211.

For the first 32 count states of the counter 402, the output state of flip-flop 404 is Q="0". When the state of the flip-flop 404 is Q="0", the 2's complement 209 does not perform a 2's complement operation on its input data. Therefore, the first 32 addressed words from the 8-foot odd main register 34 will be transferred unaltered to the adder 211.

When the up/down counter 401 reverses its count direction and when it has been incremented 17 times, a STATE RESET signal is generated which is used to set the flip-flop 403 so that its output state changes to Q="1". In response to the state Q="1", the 2's complement 210 will perform a 2's complement on the binary data words received from the even main register before this data is sent to the adder 211. The net result is that for the corresponding data word addresses 17 to 32 in the note register 35, (or any other note register in the set of tone generators that has been assigned to be loaded during a transfer cycle) the even 8-foot main register 206 data word contents are read out in reverse order, 2's complemented and added to the contents of the 8-foot odd main register which during this same set of clock timing pulses are also being read out in reverse order.

The data read out address for the odd and even main registers is selected by address select 208 under command by the executive control 16. During the transfer cycle, the main register data addresses are taken from the states of the up/down counter 401.

When the counter 402 is incremented to its count state 33, a STATE 32 RESET signal is generated and sent to set flip-flop 404 so that its output state becomes Q="1". Therefore in response to the state Q="1" for flip-flop 404, the 2's complement 209 will perform a 2's complement operation on the binary data received from the 8-foot odd main register 34 before this data is transferred to the adder 211. The STATE 33 RESET signal generated by counter 402 is also used to reset flip-flop 403 via logic OR gate 205. During timing counts from 33 through 64, flip-flop 404 has its output state set at Q="1", so that the 2's complement 409 will perform a 2's complement on all the data addressed out from the 8-foot odd main register 34.

At count 33 of counter 402, as previously described, flip-flop 403 has been reset so that its output state is Q="0". Consequently for timing counts in the transfer cycle from 33 through 48, the 2's complement 210 will not complement the data addressed out from the 8-foot even main register 206.

At count 49 of the transfer cycle, up/down counter 401 again reverses its count direction and generates the STATE RESET signal which, as described above, places the flip-flop 403 into the state Q="1". As a result, for counts 49 through 64, the data addressed out from the 8-foot even main register 206 will have a 2's complement operation performed before the data is transferred to the adder 211.

At the 65'th count, a STATE ZERO RESET signal is generated by counter 404. This STATE ZERO RESET signal is sent to the executive control 16 which then terminates the transfer cycle. During the first 32 clock times of the transfer cycle, the data read out from the 16-foot odd main register 106 is transferred unaltered to the adder 134. During the second 32 clock times, the data is read out in reverse memory order from the 16-foot odd main register 106. During the first 32 clock times of the transfer cycle, the data read out from the 16-foot even main register 130 is transferred unaltered by the 2's complement 133 to the adder 134. For the second 32 clock times, the data is read out in reverse memory order and a 2's complement is performed before the data is transferred to the adder 134. The data from adders 211 and 134 are summed in adder 131 whose output constitutes the desired combination of 8-foot and 16-foot data to be provided to the note registers.

The system shown in FIG. 4 is readily modified if the master data sets are computed with even symmetry such as when computed in accordance with Eq. 1 with the sine functions replaced by cosine functions. The required alteration in FIG. 4 is to eliminate the 2's complement logic blocks 133, 210, and 209.

Figure 6:
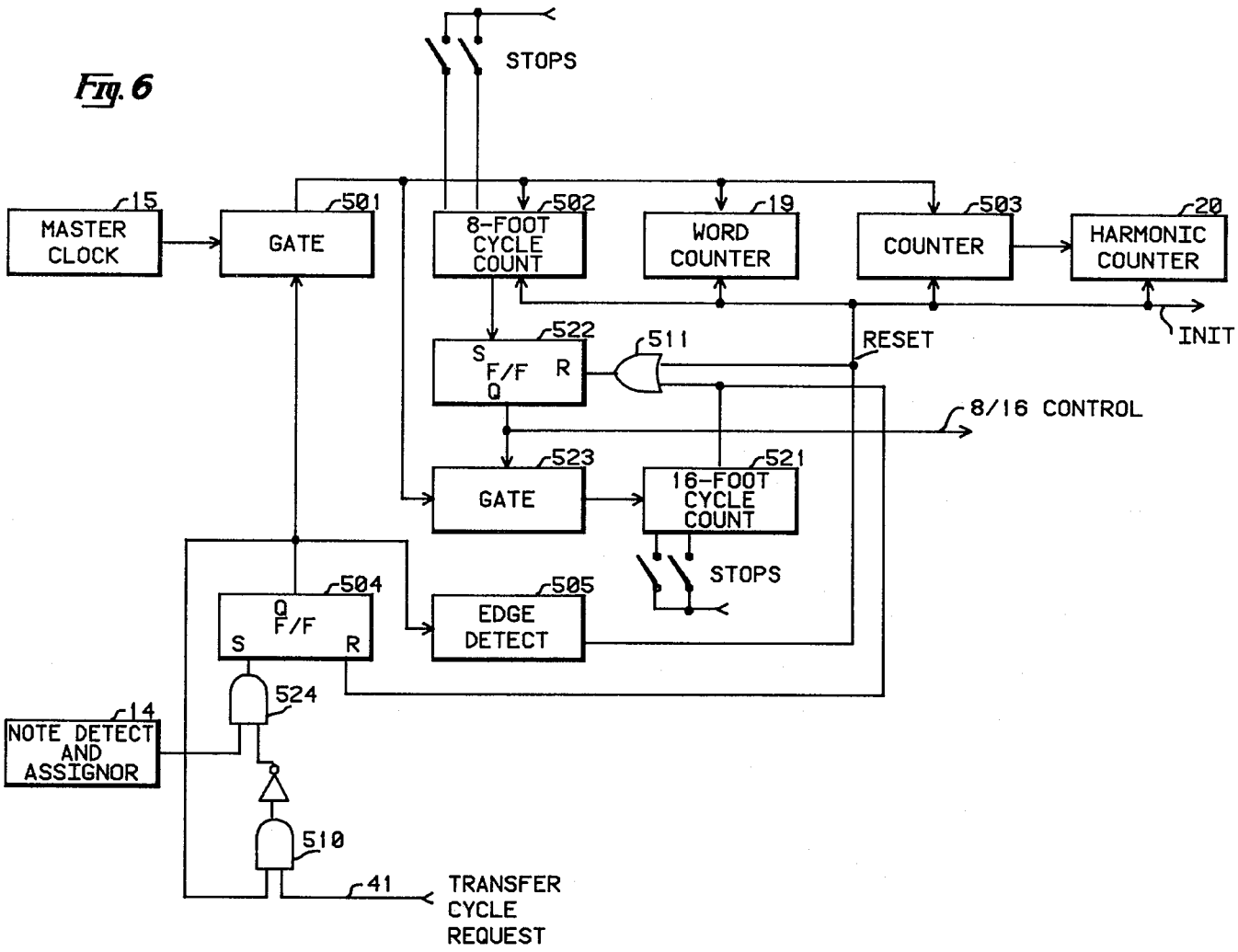
FIG. 6 is a schematic block diagram of an executive control logic.

FIG. 6 shows details of the executive control 16 used in FIG. 1 and FIG. 2. The system logic blocks in FIG. 6 having labels in the 500-number series are elements of the executive control 16. A computation is initiated when flip-flop 504 is set so that its output state is Q="1". Flip-flop 504 can be set if there is currently no request for a transfer cycle. NOR gate 510 prevents the initiation of a computation cycle if a request is present for a transfer cycle. Note detect and assignor 14 will generate a request for the start of a computation cycle if this subsystem has detected that a key has been actuated on the musical instrument's keyboard. An alternative overall system logic is to automatically initiate a computation cycle at the completion of each transfer cycle to an individual tone generator or to the entire set of tone generators.

When flip-flop 504 is set at the start of a computation cycle, the output state Q="1" is converted into a signal pulse INIT by means of the edge detect 505. The INIT signal is used to reset counters 502, 521, 503 and 20 and for other operations shown and previously described for the systems illustrated in FIG. 1, FIG. 2, and FIG. 4.

The state Q="1" causes gate 501 to transfer clock timing pulses from the master clock to increment counters 502, 19, 503 and 521. Counter 503 counts modulo 64 and each time the contents of this counter are reset due to its modulo counting action, an INCR signal is generated. The INCR signal is used to increment the harmonic counter 20.

The 8-foot cycle counter 502 is a counter modulo (64K). K is the number of 8-foot stop switches that have been actuated and 64 is the number of data words in a master data set. K is thereby equal to the number of subcomputation cycles that are implemented during the first or 8-foot, segment of the computation cycle.

At the start of a complete computation cycle, flip-flop 522 is reset so that it has a Q="0" output state of. The output state of flip-flop 522 is the 8/16 control signal.

When the 8-foot cycle counter 502 is reset after the completion of the first segment of the computation cycle, a reset signal is generated which is used to set the flip-flop 522.

When flip-flop 522 is set, the 8/16 control signal goes to the "1" state and the master clock pulses are transferred via gate 523 to increment the 16-foot cycle counter 521. The 16-foot cycle counter 521 is a counter modulo (64L), where L is the number of 16-foot stop switches that have been actuated. L is equal to the number of subcomputation cycles that are implemented during the second, or 16-foot, segment of the computation cycle.

When the 16-foot cycle counter resets itself due to its modulo counting action, the reset signal is used to reset the flip-flop 522 and the flip-flop 502 and thus causes the computation cycle to terminate.

Figure 7:
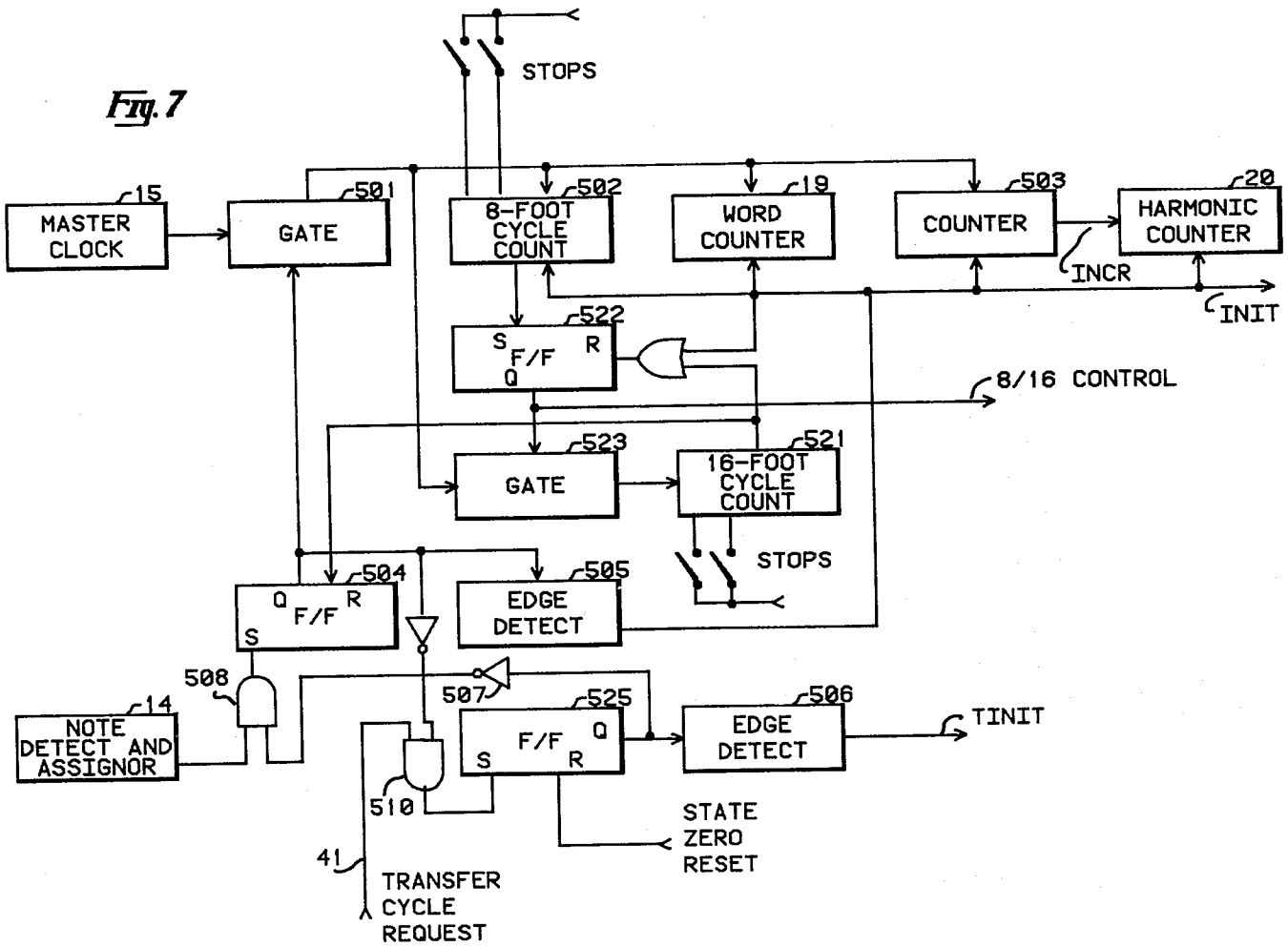
FIG. 7 is a schematic block diagram of another embodiment of the executive control logic.

FIG. 7 shows the details of the executive 16 used in FIG. 4. Those logic blocks having the same numbers as used in FIG. 6 serve the same functions as already described. In FIG. 7 a transfer cycle request on line 41 will set flip-flop 525 if a computation cycle is not in progress as indicated by a state Q="0" from flip-flop 504. The output state Q="1" from flip-flop 525 is converted into the TINIT signal by means of edge detect 506. This TINIT is used for the transfer cycle complement logic which is shown in FIG. 4 and previously described.

The state zero reset signal, generated in the complement control 207 resets the flip-flop 505 and thereby terminates a transfer cycle.

I claim:

1. A musical instrument for simultaneously producing musical tones at different pitches, comprising;

a means for computing a first and second master data set during each computation cycle of a sequence of computation cycles wherein said first master data set corresponds to a preselected musical tone at a selected first pitch and wherein said second master data set corresponds to a preselected musical tone at a selected second pitch, a data combining means for combining said first and second master data sets into a combination master data set, a first memory means for storing said combination set to be thereafter read out, a second memory means for storing input data to be thereafter read out, data transfer means for addressing out said combination master data set from said first memory means and for writing said addressed out combination master data set in said second memory means, a means for producing musical waveshapes from data read out from said second memory means, and a memory addressing means for addressing said second memory means in a first direction to read out said combination master data set in a first order and then for addressing said second memory means in a second direction to read out said combination master data set in a second order opposite to said first order wherein said read out combination master data set values are provided to said means for producing musical waveshapes thereby simultaneously producing said musical tones at different pitches.

2. A musical instrument according to claim 1 wherein said means for computing comprises;

a table of orthogonal function values, a first coefficient memory storing a set of harmonic coefficients each specifying the relative amplitude of a respective one of a first set of harmonic components which constitute said first master data set, a second coefficient memory storing a set of harmonic coefficients each specifying the relative amplitude of a respective one of a second set of harmonic components which constitute said second master data set, an evaluating means, operative during each computation cycle comprised of a first computation cycle segment and a second computation cycle segment, for separately evaluating each of said first set of harmonic components by multiplying the harmonic coefficient value for that harmonic component, accessed from said first coefficient memory, by an orthogonal function value read out of said table of orthogonal functions and associated with that harmonic component at each word of said first master data set, and for separately evaluating each of said second set of harmonic components by multiplying the harmonic coefficient value for that harmonic component, accessed from said second coefficient memory, by an orthogonal function value associated with that component at each word of said second master data set, and means for accumulating said evaluated harmonic components to obtain said first and second master data sets.

3. A musical instrument according to claim 2 further comprising:

a word counter means incremented at each computation time in said computation cycle wherein said word counter means counts modulo the number of elements in said combination master data set, a harmonic counter means incremented each time said word counter means returns to its initial state wherein contents of said harmonic counter means corresponds to an order number of said first and second sets of harmonic components, an adder-accumulator means, operative at each successive time in said computation cycle, for adding said order number to the sum previously contained in said adder-accumulator, and means for obtaining said orthogonal function values in response to contents of said adder-accumulator during said first computation cycle segment of said computation cycle and for obtaining said orthogonal function values in response to a fractional value of contents of said adder-accumulator during said second computation cycle segment of said computation cycle.

4. A musical instrument according to claim 3 wherein said means for obtaining comprises;

an adder-accumulator means, operative at each successive computation time in said computation cycle, for repeatedly adding contents of said harmonic counter means during said first computation cycle segment of the computation cycle to the sum previously in said adder-accumulator means, and for repeatedly adding a fractional value of contents of said harmonic counter means during said second computation cycle segment of the computation cycle to the sum previously in said adder-accumulator means, and a table addressing means for accessing orthogonal function values from said table of orthogonal functions corresponding to sums contained in said adder-accumulator means.

5. A musical instrument according to claim 1 wherein said means for computing further comprises;

an odd computation means wherein said first and second master data sets are computed with odd symmetric values with respect to the number of elements in said first master data set.

6. A musical instrument according to claim 1 wherein said means for computing further comprises;

an even computation means wherein said first and second master data sets are computed with even symmetric values with respect to the number of elements in said first master data set.

7. A musical instrument according to claim 5 wherein said memory addressing means further comprises;

complementary means interposed between the output of said second memory means and input to said means for producing musical waveshapes for reversing the algebraic sign of values of said combination master data sets addressed out in said second order of said memory addressing means.

8. A musical instrument according to claim 1 wherein said memory addressing means further comprises;

a variable frequency clock generator, an up-down counter incremented by said variable frequency clock generator wherein contents of said up-down counter are used to address values in said second memory means, and a control means to command said up-down counter to count in an increasing count mode and then to count in a decreasing count mode.

9. A musical instrument according to claim 1 wherein said data combining means comprises an adder.

10. A musical instrument for simultaneously producing musical tones at different pitches, comprising;

a means for computing a first master data set during the first segment of a computation cycle of a sequence of computation cycles wherein the number of elements in said first master data set is equal to one-half of the number of equally spaced points corresponding to a period of said musical tone and for computing a second master data set during the second segment of a computation cycle of a sequence of computation cycles wherein the number of elements in said second master data set is equal to the number of equally spaced points corresponding to a period of said musical tone, a first memory means for storing said first master data set to be thereafter read out, a second memory means for storing said second master data set to be thereafter read out, a third memory means for storing input data to be thereafter read out, data combination means for addressing data out from said first and second memory means wherein said first and second master data sets are combined to provide a combination master data set and stored in said third memory means, a means for producing musical waveshapes from data read out from said third memory means, and a memory addressing means for addressing said third memory means in a first direction to read out said combination master data set in a first order and then for addressing said third memory means in a second direction to read out said combination master data set in a second order opposite to said first order wherein said read out combination master data set values are provided to said means for producing musical waveshapes thereby simultaneously producing said musical tones at different pitches.

11. A musical instrument according to claim 10 wherein said means for computing comprises;

a first coefficient memory storing a set of harmonic coefficients each specifying the relative amplitude of a respective one of a first set of generalized harmonic components which constitute said first master data set, a second coefficient memory storing a set of harmonic coefficients each specifying the relative amplitude of a respective one of a second set of generalized harmonic components which constitute said second master data set, an evaluating means, operative during each computation cycle, for separately evaluating each of said generalized harmonic components during said first segment of said computation cycle by multiplying harmonic coefficients provided from said first coefficient memory by an orthogonal function value associated with said generalized harmonic component at each word of said first master data set and for separately evaluating each of said generalized harmonic components during said second segment of said computation cycle by multiplying harmonic coefficients provided from said second coefficient memory by an orthogonal function associated with said generalized harmonic compoponent at each word of said second master data set, and means for accumulating said evaluated generalized harmonic components to obtain said first and second master data sets.

12. A musical instrument according to claim 11 further comprising;

a word counter incremented at each computation time in said computation cycle wherein during said first segment of the computation cycle said word counter counts modulo one-half said number of equally spaced points corresponding to the period of said musical tone and wherein during said segment of the computation cycle said word counter counts modulo said number of equally spaced points corresponding to the period of said musical tone, a harmonic counter means incremented each time said word counter means returns to its initial state wherein contents of said harmonic counter means corresponds to order number of said first and second sets of harmonic components, an adder accumulator means, operative at each successive time in said computation cycle, for adding said order number to the sum previously contained in said adder-accumulator, the resulting contents of said adder-accumulator corresponds to said argument of said orthogonal functions, and means for obtaining said orthogonal function values in response to contents of said adder-accumulator during said first segment of said computation cycle and for obtaining said orthogonal function values in response to a fractional value of contents of said adder-accumulator during said second segment of said computation cycle.

13. A musical instrument according to claim 12 wherein said means for obtaining comprises;

an adder-accumulator means, operative at each successive computation time in said computation cycle, for repeatedly adding contents of said harmonic counter means during said first segment of the computation cycle to the sum previously in said adder-accumulator means and for repeatedly adding a fractional value of contents of said harmonic counter means during said second segment of the computation cycle to the sum previously in said adder-accumulator means, a table of orthogonal functions, and a table addressing means for accessing orthogonal function values from said table of orthogonal functions corresponding to sums contained in said adder-accumulator means.

14. A musical instrument according to claim 10 wherein said means for computing further comprises;

an odd computation means wherein said first master data set is computed with odd symmetry about one-half the number of equally spaced points in said musical tone period and wherein said second master data set is computed with odd symmetry about the number of equally spaced points in said musical tone period.

15. A musical instrument according to claim 10 wherein said means for computing further comprises;

an even computation means wherein said first master data set is computed with even symmetry about one-half the number of equally spaced points in said musical tone period and wherein said second master data set is computed with even symmetry about the number of equally spaced points in said musical tone period.

16. A musical instrument according to claim 14 wherein said data combination means further comprises;

a variable frequency clock generator, an up-down counter incremented by said variable frequency clock generator wherein contents of said up-down counter are used to address values from said first memory means, a first adder means, a complementary means interposed between the output of said first memory means and said adder for reversing the algebraic sign of values of said second master data and responsive to counting mode of said up-down counter wherein values of said master data set are provided unaltered to said first adder means when said up-down counter is in an increasing count mode and wherein said values of said master data set are provided with reversed algebraic sign when said up-down counter is in a decreasing count mode, and a second memory addressing means responsive to said variable frequency clock generator wherein said second master data set is read out of said second memory means and provided as another input to said first adder means.

17. A musical instrument according to claim 15 wherein said data combination means further comprises;

a variable frequency clock generator, a first adder means an up-down counter incremented by said variable frequency clock generator wherein contents of said up-down counter are used to address values from said first memory means, a second memory addressing means responsive to said frequency clock generator wherein said second master data set is read out of said second memory means and provided as another input to said first adder means.

18. A musical instrument according to claim 14 wherein said memory addressing means further comprises;

complementary means interposed between the output of said third memory means and input to said means for producing musical signals for reversing the algebraic sign of values of said combination master data set addressed out in said second order of said memory addressing means.

19. A musical instrument according to claim 10 wherein said memory addressing means further comprises;

a variable frequency clock generator, an up-down counter incremented by said variable frequency clock generator wherein contents of said up-down counter are used to address values in said third memory means, and a control signal to command said up-down counter to count in an increasing count mode and then to count in a decreasing count mode.

20. In a musical instrument for simultaneously producing musical tones at different pitches having one or more tone generators in which a plurality of data words corresponding to the amplitudes of a corresponding number of evenly spaced reference points defining the waveform of one cycle of an audio signal are transferred sequentially from a note register to a digital-to-analog converter at a rate proportional to the pitch of the tone being generated, apparatus for simultaneously producing musical tones at different pitches comprising;

means for creating first and second master data sets during a computation cycle comprising a first and second segment and wherein the number of data points in each of said master data sets is the same and is less than the number M of points defining said waveform and wherein said first master data set corresponds to a preselected tone at a selected first pitch and said second master data set corresponds to a preselected tone at a selected second pitch, a first memory means for storing said first master data set to be thereafter read out, a second memory means for storing said second master data set to be thereafter read out, a third memory means for storing input data to be thereafter read out, a data combination means wherein data read out of said first and second memory means are combined to provide a combination master data set and stored in said third memory means, a means for producing musical waveshapes from data read out from said third memory means, and a memory addressing means for addressing said third memory means in a first direction to read out said combination master data set in a first order and then for addressing said third memory means in a second direction to read out said combination master data set in a second order opposite to said first order wherein said read out combination master data set values are provided to said means for producing musical waveshapes thereby simultaneously producing said musical tones at different pitches.

21. A musical instrument according to claim 20 wherein said means for creating a first and second master data set further comprises;

a master data set generation means whereby said first master data is created from the combination of a first odd-symmetric submaster data set and a first even-symmetric data set, and whereby said second master data set is created from the combination of a second odd-symmetric submaster data set and a second even-symmetric master data set.

22. A musical instrument according to claim 21 wherein said means for creating a first and second master data set further comprises;

a first even coefficient memory storing a set of even harmonic coefficients $c_q$ corresponding to the even values $q=2,4,9 \ldots$ for said harmonic harmonic number q, a first odd coefficient memory storing a set of odd harmonic coefficients $d_q$ corresponding to the odd values $q=1,3,5 \ldots$ for said number q, a second even harmonic coefficient memory storing a set of harmonic coefficients $d_q$ corresponding to said even values of said harmonic number q, a second odd coefficient memory storing a set of odd harmonic coefficients $c_q$ corresponding to the odd values $q=1,3,5, \ldots$ for said harmonic number q, an evaluating means for computing data values $Z_N$, $N=1,2, \ldots 2M$ in said first odd master data set using said odd harmonics $c_q$ read out of said first odd coefficient memory whereby said data values $Z_N$ are odd-symmetric about the quarter-wave and half-wave ponts of said waveform; for computing data values $Z'_N$ in said first even master data set using said even harmonics $c_q$ read out of said first even coefficient memory whereby said data values are even-symmetric about the quarter-wave point and are odd-symmetric about the half-wave point; for computing data value $Y_N$ in said second odd master set using odd harmonics $d_q$ read out of said second odd coefficient memory whereby said data values $Y_N$ are odd-symmetric about the data point M/2 and odd-symmetric about the data point M; and for computing data values $Y'_N$ in said second master data set using said even harmonics $d_q$ read out of said even coefficient memory whereby said data values $Y'_N$ are even-symmetric about data point M/2 and odd-symmetric about data point M, and a first memory means further comprising a first odd-symmetric memory for storing said first odd master data set and a first even-symmetric memory for storing said first even master data set.

23. A musical instrument according to claim 22 wherein said data combination means comprises;

a variable frequency clock for generating clock pulses, a reversible counter means whereby memory addresses are generated for said first odd-symmetric memory and said first even symmetric memory in ascending values for a number P of said variable frequency clock pulses corresponding to the number of points in one-quarter cycle of said musical waveshape, are generated in reverse descending values for the second number P of said variable frequency clock pulses, are generated in ascending value for the third number P, and are generated in reverse descending value for fourth number P of said clock pulses, a signal generator means responsive to said reversible counter means wherein a control signal is generated when said reversible counter means changes from an ascending count mode to a descending count mode or when the reversible counter means changes from a descending count mode to an ascending count mode, a first algebraic sign means wherein data read out from said first odd memory is changed in algebraic sign in response to said control signal, a second algebraic sign means wherein data read out from said first even memory is changed in algebraic sign in response to said control signal, and a first adder means wherein data furnished by said algebraic sign means are summed to provide a complete cycle of points for said first master data set.

24. A musical instrument according to claim 23 wherein said data combination means further comprises;

an up-down counter incremented by said variable frequency clock generator wherein contents of said up-down counter are used to address data values from said second memory means, a second adder means, a complementary means interposed between the output of said second memory means and said second adder for reversing the algebraic sign of said second even master data set values and responsive to counting mode of said up-down counter wherein values of said first even master data set are provided unaltered to said second adder means when said up-down counter is in an increasing count mode and wherein said values of said master data are provided with reversed algebraic sign when said up-down counter is in a decreasing count mode, and a third adder means for summing the output from said first and second adder means thereby forming said combination master data set.

25. A musical instrument according to claim 20 wherein said memory addressing means further comprises;

complementary means interposed between the output of said third memory means and input to said means for producing musical signals for reversing the algebraic sign of values of said combination master data set addressed out in said second order of said memory addressing means.

26. A digital polyphonic tone synthesizer for simultaneously producing tones at different pitches comprising;

a keyboard comprising a plurality of key switches, a plurality of tone switches wherein each setting of the tone switches corrsponds to a selection of a predetermined sound waveshape at different pitches, digital computing means responsive to the setting of said tone switches for generating a first master data set having words corresponding to a succession of points on a cycle of said first selected sound waveshape and for generating a second master data set having words corresponding to a succession of points on a half-cycle of a second waveshape at a pitch one-half the frequency of said first selected sound waveshape, a plurality of registers, transfer means responsive to the setting of any said key switches whereby said first and second master data sets are formed into a combination master data set and transferred from said digital computing means for storage in selected members of said plurality of registers, a plurality of variable frequency clock generators each associated with a member of said plurality of registers whereby associated registers are shifted at a selected clock rate, means responsive to operation of any member of said plurality of key switches for setting the frequencies of said clock generators to predetermined values assigned to key switches, digital-to-analog signal conversion means, and a memory addressing means for addressing stored combined master data sets in each member of said plurality of registers to said digital-to-analog signal conversion means in synchronism with said associated clock generator wherein said memory addressing means addresses said member of the plurality of registers in a first direction to read out said combination master data set in a first order and then for addressing said member in a second direction to read out said combination master data set in a second order opposite to said first order wherein said read out combination master data set values are provided to digital-to-analog signal conversion means thereby simultaneously producing said musical tones at different pitches.

27. Apparatus according to claim 26 wherein said digital computing means comprises;

an odd computation means wherein said first and second master data sets are created with odd symmetric values.

28. Apparatus according to claim 26 wherein said digital computing means comprises;

an even computation means wherein said first and second master data sets are created with even symmetric values.

29. Apparatus according to claim 27 wherein said memory addressing means further comprises;

complementary means interposed between the output of each member of said plurality of registers and said digital-to-analog signal conversion means for reversing the algebraic values of said combination master data addressed out in said second order of said memory addressing means.

* * * * *

UNITED STATES PATENT AND TRADEMARK OFFICE

CERTIFICATE OF CORRECTION

PATENT NO. : 4,257,304

DATED : March 24, 1981

INVENTOR(S) : Ralph Deutsch

It is certified that error appears in the above-identified patent and that said Letters Patent are hereby corrected as shown below:

Column 13, line 60 change "state of." to --state.--.

Column 19, line 62 after "even-symmetric" insert --submaster--.

Column 20, line 3 change "q=2,4,9..." to --q=2,4,8...--.

Column 20, line 32 after "out of said" insert --second--.

Column 21, line 21 after "data" insert --set--.

Column 21, line 43 change "corrsponds" to --corresponds--.

Signed and Sealed this

*Second* Day of *June 1981*

[SEAL]

*Attest:*

RENE D. TEGTMEYER

*Attesting Officer*

*Acting Commissioner of Patents and Trademarks*